United States Patent [19]

Iwata

[11] 4,305,764

[45] Dec. 15, 1981

[54] METHOD OF PRODUCING FE/CR/CO PERMANENT MAGNET ALLOY

[75] Inventor: Masao Iwata, Chichibu, Japan

[73] Assignee: Hitachi Metals, Ltd., Tokyo, Japan

[21] Appl. No.: 102,843

[22] Filed: Dec. 12, 1979

[30] Foreign Application Priority Data

Dec. 14, 1978 [JP] Japan ..... 53-154360

[51] Int. Cl.[3] ..... H01F 1/02

[52] U.S. Cl. ..... 148/103; 148/102; 148/108; 148/121; 148/31.57

[58] Field of Search ..... 148/102, 103, 108, 121, 148/31.55, 31.57

[56] References Cited

U.S. PATENT DOCUMENTS

| | | | |
|---|---|---|---|
| 3,954,519 | 5/1976 | Inoue | 148/121 |
| 3,982,972 | 9/1976 | Iwata et al. | 148/121 |
| 4,008,105 | 2/1977 | Yuda et al. | 148/31.57 |
| 4,093,477 | 6/1978 | Iwata et al. | 148/121 |
| 4,194,932 | 3/1980 | Iwata | 148/103 |

FOREIGN PATENT DOCUMENTS

| | | |
|---|---|---|
| 49-20451 | 5/1974 | Japan . |
| 50-37011 | 11/1975 | Japan . |
| 51-38224 | 3/1976 | Japan . |
| 51-52318 | 5/1976 | Japan . |
| 51-79631 | 7/1976 | Japan . |
| 51-29859 | 8/1976 | Japan . |
| 53-99027 | 8/1978 | Japan . |
| 53-35536 | 9/1978 | Japan . |

OTHER PUBLICATIONS

Kaneko et al., IEEE Trans. on Magnetics, vol. MA-G-12, No. 6, Nov. 1976, pp. 977-979.

Kaneko et al., IEEE Trans. on Magnetics, vol. MA-G-11, No. 5, Sep. 1975, pp. 1440-1442.

English language abstract of Japanese Patent Laid-Open Publication No. 79631/1976; Abstract No. 65503.

*Primary Examiner*—L. Dewayne Rutledge

*Assistant Examiner*—John P. Sheehan

*Attorney, Agent, or Firm*—Craig and Antonelli

[57] ABSTRACT

A method of producing an anisotropic magnet alloy containing iron, chromium and cobalt as the major constituents. The method has a step of aging treatment of the alloy in a magnetic field for permanentally magnetizing the alloy. The aging treatment in the magnetic field is conducted by at first treating the alloy at a temperature below the two-phase separation temperature of the alloy, under application of the magnetic field, thereby to form an anisotropic two-phase separated microstructure, and cooling the alloy continuously at a rate which is not so great, while maintaining the application of the magnetic field, thereby to make the two separated phases approach the equilibrium structures at lower temperature. By so doing, the undesirable disorder of anisotropy is avoided because the magnetic field is maintained to order the two-phase separated microstructure even if a new two-phase separated microstructure is formed during the cooling.

18 Claims, 10 Drawing Figures

METHOD OF PRODUCING FE/CR/CO PERMANENT MAGNET ALLOY

This invention relates to an improved method of producing Fe/Cr/Co permanent magnet alloys, and more particularly to an improved method of producing such magnet alloy which can be practiced with a high efficiency on an industrial scale and whereby the advantageous characteristics particular to the component constituents used in the production of the alloys can be obtained at a maximum level.

Many magnet alloys comprising as main component constituents iron, chromium and cobalt have been commonly known for many publications and papers. For instance, in Japanese Patent Publication No. 20451/1974, there is disclosed such a magnet composition containing 15 to 35% by weight of cobalt, 3 to 50% by weight of chromium and the remainder being essentially of iron. In Japanese Patent Publication No. 29859/1976 there is disclosed a magnetic alloy containing 20 to 35% by weight of chromium, 10 to 20% by weight of cobalt, 0.3 to 3% by weight of titanium and the remainder being essentially of iron, and Japanese Patent Publication No. 35536/1978 discloses a magnet alloy consisting of 17 to 35% by weight of chromium, 5 to 20% by weight of cobalt, 0.3 to 3% of silicon by weight, and the remainder being essentially of iron.

On the other hand, with respect to the prior processes of producing such Fe/Cr/Co magnet alloys, for instance, there are such disclosures as Japanese Patent Publication No. 20451/1974 which comprises the steps of subjecting an obtained alloy to solution treatment after melting and casting operations, and conducting aging treatment on the thus solution treated alloy in a magnetic field, thereafter subjecting it to aging, while Japanese Patent Publication No. 37011/1975 is characterized by the steps of conducting aging treatment on the product in the presence of a magnetic field after the solution treatment, and subjecting it to cold working, thereafter subjecting it to a multi-stage aging treatment.

Also, in Japanese Patent Laid-Open Publication No. 52318/1976, there is disclosed a solution treatment method characterized by the step of maintaining the alloy material in a temperature range from 650° up to and inclusive of 1085° C. for a time period of 3 to 300 minutes, while in the Japanese Patent Laid-Open Publication No. 38224/1976 there is disclosed a process characterized by the step, as the treatment procedure prior to a cold plastic deformation step, of maintaining the alloy at the temperature range of from 850° up to and inclusive of 1085° C. for a time period of 3 to 300 minutes.

In the Japanese Patent Laid-Open Publication No. 79631/1976, there is disclosed a method of effecting an aging treatment characterized by the step of continuously and slowly cooling the alloy at a slow cooling rate such as 5 minutes to 50 hours/10° C. at least throughout a temperature unit of 10° C. from an optional temperature in the range of 700° to 400° C.

As a further example, in the periodical publication entitled "IEEE Transactions on Magnetics", Vol. MAG-12, No. 6, pp 977 to 979 (issued by the American Institute of Electrical and Electronical Engineers in November, 1976), there is disclosed a method of heat treatment which comprises the steps of maintaining an alloy at a predetermined temperature in a magnetic field, then cooling it down to an ambient temperature, thereafter conducting a secondary aging treatment by way of a multistage aging system without any magnetic field, and another method comprising the steps of maintaining an alloy material at a given temperature in a magnetic field, thereafter providing continuous and gradual cooling aging treatment on it from the above mentioned temperature level without applying any magnetic field.

In the conventional production process of multicomponent magnet alloys containing iron, chromium and cobalt as main components, it has been a general practice to form such an alloy material in a desired shape through serial processes of melting, casting, hot working, cold working, etc., and of conducting a solution treatment either during such series of processing, if necessary, or after such processes, and then finally subjecting the alloy to an aging treatment, thus making the alloy material have permanent magnet properties.

It is preferable that the above-mentioned solution treatment be applied particularly to a material which has been cold-worked, while with a material which has been subjected to a hot working only and which has little or no residual strain due to the working, it is recommended, in view of the material's properties, to apply an aging treatment thereto without any solution treatment.

The above-mentioned aging treatment is a practical step to make the alloy have permanent magnet properties which is a significant step that would cause a critical influence on the magnetic properties of alloy products. This particular process of aging treatment is an important step, as fully disclosed by the inventor in the Japanese Patent Laid-Open Publication No. 79631/1976 who is the same as that of the present invention, and it preferably should be practiced in such a manner to cool the material from any optional temperature level in the range of 700° to 400° C. continuously and gradually at such a cooling rate that a temperature drop of 10° C. is obtained in a time period of from 5 minutes to 50 hours at least throughout a temperature unit of 10° C. Particularly, during that cooling procedure, the continuous and gradual cooling of the material through the temperature range of 650° C. to 450° C. particularly 600° to 500° C., causes an outstanding effect on the improvement of the magnetic properties of the product. In order to enhance the magnetic properties of the alloy, it is often necessary to make an alloy magnetically anisotropic by carrying out a part or all of this aging treatment in a magnetic field (thermo-magnetic treatment). However, the above-mentioned continuous cooling aging method has been considered not to be adequate for thermo-magnetic treatment for a reason mentioned hereinafter precisely from the metallurgical point of view.

Therefore, an anisotropic Fe/Cr/Co magnet has been made by the method which includes maintaining the alloy at a predetermined temperature in a magnetic field, thereafter providing a continuous and gradual cooling aging treatment (secondary aging treatment) on the alloy without a magnetic field, or, as disclosed by the inventor of the present invention in the Japanese Patent Laid-Open Publication No. 99027/1978 a method which involves maintaining the alloy at a predetermined temperature in a magnetic field, then cooling the alloy down to an ambient temperature, thereafter re-heating the alloy up to a temperature which is lower than the temperature of above-mentioned thermo-magnetic treatment and providing the above-mentioned continuous and gradual cooling aging treatment (secondary aging treatment) on the alloy without a magnetic field.

As has been described, there have been many publications concerning a magnet alloy containing Fe,Cr and Co as the main constituents, and an improvement in the properties and rationalization of the production process have been achieved steadily. Thus, the applicability or use of this type of magnet alloy is spreading more and more.

From the view point of the component constitutents, this type of magnet alloy offers also the following advantage. Namely, on a recognition of the current demand for saving of mineral resources, and taking into consideration that cobalt is a precious element which is 100% import in case of Japan, it is remarkable that the Fe/Cr/Co magnet alloy exhibits an equivalent property to that of Alnico-5 magnet which is most popular magnet alloy available now, with a cobalt content which is a half of that of the Alnico-5 magnet.

The future subjects points of interest are further improvement of the permanent magnet property, stabilization of heat treatment and facilitation of the heat treatment. Thus, there is an increasing demand for the improvements in the points mentioned above.

As will be detailed later, this type of magnetic alloy has a magnetic property which is highly sensitive inherently to the reaction at the initial stage of the aging treatment. Thus, it is known to those skilled in the art that the above-stated process of producing an anisotropic Fe/Cr/Co alloy has a critical drawback that the magnetic property of the magnet product largely fluctuates even due to a slight change in the temperature of the aging treatment in the magnetic field. This in turn offers various problems. For instance, it is extremely difficult to stably obtain the expected magnetic property of the product. In addition, it is not possible to effect the heat treatment at a time on the same large number of articles.

For these reasons, the production of this kind of alloy has not been put into practice, in spite of increasing demand in various fields of industry for rapid development of practical process for producing this type of magnet alloy, which demand being keen from the view point of saving of natural resources.

Under these circumstances, the present invention aims at providing a method of heat treating a Fe/Cr/Co magnet alloy, which is able to provide a stable magnet alloy and which is easy to carry out.

To this end, according to one aspect of the invention, there is provided a process of producing an anisotropic Fe/Cr/Co permanent magnet alloy in which at least a part of the aging treatment is effected in a magnetic field, to make the alloy have an anisotropic permanent magnet property, comprising the steps of treating, during the aging treatment in the magnetic field, the alloy in the magnetic field at a first temperature below the two-phase-separation temperature of the alloy, i.e. the transformation temperature at which two phases occur from a single phase and further treating the alloy at a second temperature lower than the first temperature under application of magnetic field in the same direction.

According to another aspect of the invention, there is provided a aging method of heat treatment of an anisotropic Fe/Cr/Co magnet alloy characterized in that the aging treatment in the magnetic field is conducted by a continuous cooling over a predetermined temperature range, and that the cooling in the magnetic field is commenced at a first temperature higher than the two-phase-separation temperature of the alloy and continued down to a second temperature which is at least lower than the two-phase-separation temperature, thereby to start the two-phase separation reaction during the period of the continuous cooling to form the structure of the anisotropic Fe/Cr/Co alloy.

Thus, in the these two methods of aging heat treatment, the separation into two phases, which affects the generation of permanent magnet property does not take place in the initial stage of the aging treatment in the magnetic field. Accordingly, it becomes unnecessary to effect a precise temperature control. Although a constant cooling rate is required instead of the precise temperature control for stabilizing the magnetic property of the products, such a control for maintaining a constant cooling rate is comparatively easy to realize even in production on an industrial scale.

According to the invention, the above-mentioned Fe/Cr/Co alloy contains 17 to 45% by weight of chromium, 3 to 35% by weight of cobalt and the remainder essentially iron. The invention, however, does not exclude the addition of less than 5 weight % of silicon, titanium, vanadium, nickel, niobium, aluminum, tin, magnanese, sulfur, zirconium, zinc, lead or the like elements to the above stated constituents.

A sufficient coercive force for maintaining permanent magnet cannot be obtained if the chromium and cobalt contents are similar than the above specified values. Also, a chromium content exceeding 45% will cause a deterioration of workability and insufficient residual magnetic flux density essential for the permanent magnet. Further, a cobalt content exceeding 15% will result in a poor workability, so that the cobalt content is preferably maintained below 15%, particularly when the product is to be subjected to a deep drawing.

A cobalt content in excess of 35% will result in an insufficient residual magnetic flux density for a permanent magnet. The range of contents at which the effect of the invention is most remarkable is 23 to 35% of chromium and 5 to 20% of cobalt. Also, it is recommended to add 0.3 to 3% of tin, in order to improve the fluidity of the molten metal and to facilitate the solution treatment in the production of the alloy.

The adequate cooling rate during the continuous cooling treatment in the magnetic field varies depending on the alloy composition. However, generally, a superior effect is obtained when the temperature is lowered at a rate of 0.05° to 10° C. per minute. If the cooling rate at high temperature range is smaller than the above-specified rate, the development of binodal (i.e. a two phase) structure due to a nucleation-and-growth mechanism explained later is promoted and over-aging phenomenon proceeds, both of which results in a deterioration of the permanent magnet property. On the other hand, in the low temperature range, the improvement of the property is accelerated as the cooling rate becomes smaller. This tendency, however, is saturated when the cooling rate is decreased to 0.05° C. per minute, and the further improvement cannot be attained even if the cooling rate is lowered below that rate. To the contrary, a cooling rate exceeding 10° C. per minute can provide only an insufficient two-phase separation. Particularly, a superior magnetic property is obtained over a wide range of alloy composition when the cooling rate falls within the range of between 0.2° and 5° C. per minute, preferably 0.5° and 2° C.

The above and other objects, as well as advantageous features of the invention will become clear from the following description of the preferred embodiments taken in conjunction with the accompanying drawings.

Figure 1A:
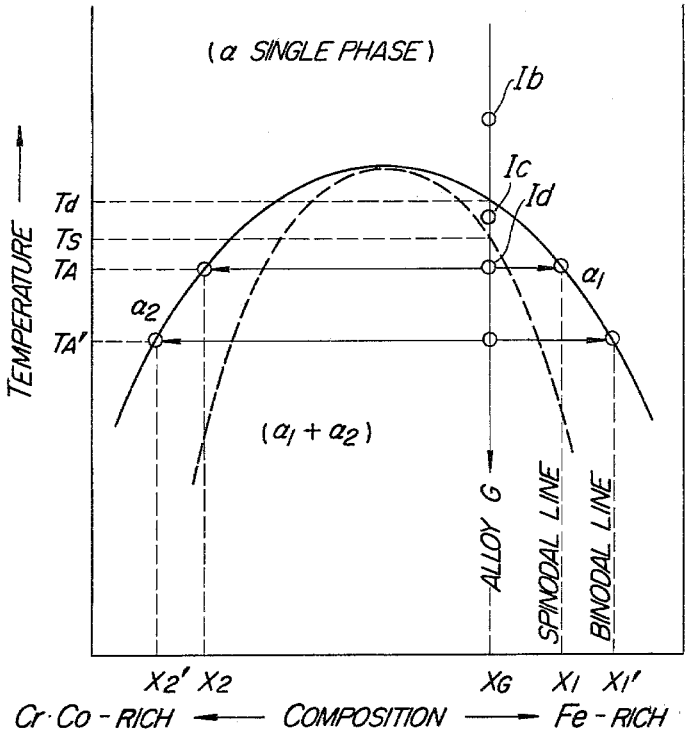
FIG. 1 is a phase diagram of an Fe/Cr/Co alloy.
Figure 1B:
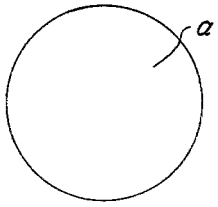
Figure 1C:
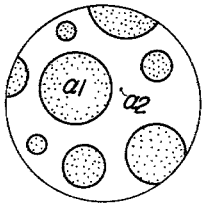
Figure 1D:
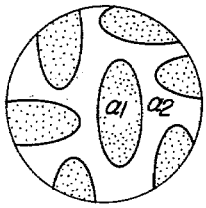

The present invention was materialized essentially through the inventor's deliberate studies on the aging treatment stated hereinbefore. In this consideration, description will now be given in detail for a better understanding of the present invention from the standpoint of a metallographic approach.

Under the effect of an aging treatment, an Fe/Cr/Co magnet alloy is caused to be separated from a homogeneous solid solution (hereinafter referred to as "$\alpha$ phase") into two phases, i.e., a ferromagnetic phase (hereinafter referred to as "$\alpha_1$ phase") and a non-ferromagnetic or inferior ferromagnetic phase (hereinafter referred to as "$\alpha_2$ phase").

FIG. 1 (*a*) is a schematic phase diagram qualitatively showing the state of phase distribution of the two phases.

Papers published up to present state that the $\alpha_1$ phase would be rich in Fe and Co, and the $\alpha_2$ phase rich in Cr. However, though it has not yet been completely confirmed in the exact sense from a metallographical view, a deliberation of the inventor of present invention suggests that Co has an affinity for Cr rather than Fe, so that $\alpha_2$ phase is rich in Cr and Co, therefore the remaining $\alpha_1$ phase is rich in Fe, or Fe and Co.

A solid curved line in FIG. 1 (*a*) is called a binodal line and shows a miscibility gap of the alloy system, so at the outer side (higher temperature) of the line an alloy is a single phase ($\alpha$ phase), and at the inner side (lower temperature) of the line a two-phase separation into $\alpha_1$ phase and $\alpha_2$ phase takes place. The broken curved line in the two-phase range in FIG. 1 (*a*) is called a spinodal line and defined thermodynamically. In the range between the spinodal line and the binodal line a two-phase separation takes place by a nucleation-and-growth mechanism, and at inner side (lower temperature) of the spindal line a two-phase separation takes place by a spinodal decomposition mechanism.

Referring to FIG. 1 (*a*), the compositions of the Fe/Cr/Co magnet alloy system are, for instance, shown with the value of XG on the abscissa of the coordinates, and therefore, according to the schematic diagram, this alloy G is a single $\alpha$ phase at a higher temperature, while when the alloy G is subjected to the aging treatment at a temperature, for instance, of $T_A$, lower than a two-phase separation temperature Td, the alloy G is separated into two phases, i.e., $\alpha_1$ of composition $X_1$, and $\alpha_2$ of composition $X_2$.

If the aging temperature changes, there occurs a difference in the compositions of each phase to be separated, for instance, when the alloy G is subjected to an aging treatment at a temperature $T_A'$, the alloy is now separated into two phases; i.e., $\alpha_1$ of a composition $X'_1$ and $\alpha_2$ of a composition $X'_2$. And, as typically shown in FIG. 1 (*d*), a ferromagnetic $\alpha_1$ phase finely disperses in a non-magnetic $\alpha_2$ phase as a single domain particle, and its shape is elongated so that it has a shape magnetic anisotropy wherein the orientation of each elongated particle coincides with a direction of easy magnetization, consequently there generated a high Hc due to the single domain particle theory as explained by Stoner and Wohltarth, in principle, thus resulting in excellent permanent magnetic properties. ($Hc=2Ku/Is$; Ku: uniaxial magnetic anisotropy constant, Is: saturation magnetization of $\alpha_1$ particle). (Note: Although, in FIG. 1 (*c*) and (*d*), an $\alpha_1$ phase was drawn as a precipitated particle, for convenience of this interpretation, as the inventor of present invention believes that the precipitating one is the $\alpha_2$ phase, a phase diagram shown as FIG. 1 (a) has been prepared.)

By virtue of such magnetial hardening mechanism as stated above, the magnetic properties of the alloy according to this invention is essentially dependent upon geometrical factor of the two-phase separated micro structure (i.e., configuration, size, volumetric ratio of the two phases, etc.) as well as a value of saturated magnetization of each of thus separated two phases (consequently, chemical composition of the two component phases). Now, description is given further on the desirable conditions wherein the present Fe/Cr/Co magnet alloy can display excellent magnetic properties. In the first place, as for a geometrical factor, the requirement for the size of the $\alpha_1$ phase of the alloy is such that it should not be too coarse in view of the necessity that it must act in the manner of a single domain particle, and on the other hand, it should not be too fine as it is not desired that it may behave in a super-paramagnetic manner. In this respect, it is desirable that the $\alpha_1$ phase be of ferromagnetic particle having a size in the order ranging from about several hundreds through several thousands of angstrom. In order to meet the requirements for as excellent a permanent magnet product, it is essentially required that each $\alpha_1$ particle should have a magnetic anisotropy as great as possible i.e. each $\alpha_1$ particle should be elongated as much as possible, and also $\alpha_1$ particle should have uniform magnetic anisotropy as a whole, namely, each particle should have the same orientation to each other. As known well, it is sometimes effective to apply a magnetic field when a two-phase separation process takes place, for the purpose of meeting the above-mentioned two conditions.

With respect to a volumetric ratio between the two phases, if there are observed too little formation of $\alpha_1$ phase in the alloy structure, a value of saturated magnetization will become smaller as a magnet body, while formation of an excessive amount of such $\alpha_1$ phase, there will occur magnetic interaction between $\alpha_1$ phases, as the distance between these phases becomes too small, resulting in a decrease in the magnetic anisotropy of the alloy, and each $\alpha_1$ particle being unable to act like a single domain particle perfectly. In this respect, both cases lead to decreasing of Hc and turn out to be objectionable for the purpose of obtaining excellent magnetic properties. In the case of Alnico alloys whose mechanism of magnetic hardening is similar to that of Fe/Cr/Co alloys, it is said that the good magnetic properties are obtained if the value of volumetric fraction of $\alpha_1$ phase equals to about 50–80%.

By the way, in order to let an alloy have a good magnetic properties, it is needed not only to make the above-mentioned geometrical factors be ideal, but also to make the difference of saturation magnetization between $\alpha_1$ and $\alpha_2$ phases be large. Namely, it is needed that the saturation magnetization of $\alpha_1$ phase ($I_1$) should be large as much as possible, while that of $\alpha_2$ phase ($I_2$) small as much as possible.

The former of these two propositions means not only that a saturation magnetization and a residual flux density are increased, as can be understood easily, but also that coercive force also is enhanced in proportion to $I_1$ because the shape magnetic anisotropy is proportional to the square of $I_1$, so this proposition is important.

On the other hand, the latter of the two propositions looks somewhat surprising at first sight. However a little considerations makes us understand this because if $I_2$ has a large value of magnetization, it acts as, so to speak, a yoke, connecting each $\alpha_1$ particle together, and therefore weaken the magnetical contrast between $\alpha_1$ and $\alpha_2$ phases in spite of the metallurgical morphology of distinctly two-phase-separated structure, and this results in a little magnetic anisotropy leading to a little coercive force.

As fully discussed above, since each factor which would affect magnetic properties of a magnet vary greatly in various ways with given heat treatment conditions of an aging treatment, the thus obtained magnetic properties will change extensively depending on the given aging treating conditions. Among such factors, the above mentioned geometrical factor has a particularly high dependency upon the aging conditions in a relatively high temperature range of the aging treatment. Namely, at a temperature range higher than the point of two-phase separation Td as shown in FIG. 1 (*a*) there takes place no two-phase separation in an aging treatment of the alloy, being left to be still in a single phase as shown in FIG. 1 (*b*), there is observed little extent of Hc. At a temperature immediately below the pint Td, due to the nucleation-and-growth mechanism of precipitation, there are formed the spherical and irregular in size precipitates as shown in FIG. 1 (*c*), which will possibly turn out to be a coarse-grain structure generally due mainly to the effect of surface energy of thus-formed precipitates, the higher the aging temperature is, and the longer the aging period of time. The thus obtained structure would not bring forth any excellent magnetic properties in a product because of its lowr anisotropy in each particle, or irregularity in its magnetic anisotropy and orientation as a whole. If an aging treatment is done at a lower aging temperature than the so-called spinodal temperature Ts defined in the thermodynamics, (which is necessarily lower than the point Td), due to the spinodal decomposition mechanism, there are formed the uniform and periodical structure (modulated structure) as shown in FIG. 1 (*d*).

The thus formed structure is of a regular structure, and each particle is of a certain degree of anisotropy in its shape. If the size of such particles is in an appropriate range, there is obtained a magnet product having fairly excellent properties. The size of the thus formed modulated structure is said to be proportional to the value of $1/\sqrt{\Delta T}$, where $\Delta T$ represents a difference between the aging temperature and the spinodal temperature (Ts), thus $\Delta T = Ts - TA$; TA represents an aging temperature ($<Ts$). From this, there is formed a structure of coarser grains as the aging temperature increases. As the value $\Delta T$ is a denominator in the above equation, when the value $\Delta T \approx 0$, that is, the aging temperature level is relatively high and approximately equals to the spinodal temperature, the size of the modulated structure of the alloy is now known to be dependent very severely upon the aging temperature. In contrast, when the aging temperature is relatively low, there is formed a modulated structure having fine size. However in this case, it is known that the size of the thus formed grain does not vary so much with a given aging temperature.

In an aging treatment with a relatively high temperature, the two-phase separation mechanism per se is essentially of such a complexity as mentioned above, but also the rate of the diffusion of atoms is large in such two-phase separation. Consequently, as stated hereinbefore, there is a high dependency of the geometrical factor upon the aging treatment conditions. In this consideration, in order to obtain an ideal metallographical structure for use in an excellent permanet magnet product, it is essential to exercise particular cautions in that particular stage of heat treatment so as to obtain an optimized controlling condition. The significance of applying a magnetic field during heat treatment procedures resides in the provision of increased demagnetizing energy of the $\alpha_1$ particle extending in a direction different from the magnetic field so as to prevent an elongating trend thereof. It is therefore at this particular stage where it is possible to greatly vary the geometrical factor that the effect of applying a magnetic field during a heat treatment operation becomes so distinct.

On the other hand, the difference between the saturated magnetization values of each of two phase separated as stated above is proportional to the chemical compositions of the alloy. Therefore, as seen from FIG. 1 (*a*), this particular difference value becomes larger when a lower aging temperature is used. In this consideration, it seems preferable to select a relatively low aging temperature, however, due to the fact that the rate of the reaction caused by the aging treatment would turn out to be substantially slow and that the two-phase structure to be formed would become too small, such a relatively low temperature aging, when it is simply conducted, thus would result in only poor magnetic properties. The key to the establishment of an optimum aging treatment for bringing a magnet product of excellent magnetic properties resides eventually in finding out the conditions in which said seemingly contradictory two problems can be compromised with each other in the best manner.

For solving this problem, there have been proposed some methods, one of which is, for example, a multistage aging method which comprise the steps of firstly applying an aging treatment at a relatively high temperature so as to obtain a two-phase structure of which geometrical factor is corresponding to that temperature, thereafter repeating a further aging treatment or treatments at a relatively low temperature thereby to widen gradually the difference of the chemical compositions between the two phases. Among them, one of the most efficient method for the purpose of it, that is, widening the difference of the chemical compositions between the two phases is rather to provide a method for changing the aforesaid stepwise aging into a more smooth and continuous cooling aging so as to maintain equilibrium at each temperature while gradually lowering the temperature, as is disclosed in the Japanese Patent Laid-Open Application No. 79631/1976 by the same inventor as that of the present invention.

In such aging treatment, it is observed that once a two-phase structure has been formed at the initial stage, namely by the aging at a relatively high temperature range (hereinafter referred to as primary aging), there little progresses a changing of the micro structure wherein an atomic movement over a relatively long range is required, even through a following aging at a relatively low temperature range (hereinafter referred to as secondary aging) is given: In secondary aging these progresses principally a replacement of atoms between two phases which can be done by only a short range atomic movement, namely, widening of the difference of chemical composition between two phases. Actually, although magnetic properties are improved to a remarkable extent as the secondary aging treatment proceeds, it is known through electron microscope observation that thus formed two-phase separated structure does not vary substantially throughout the processing.

As stated before, the anisotropy for improving the Fe/Cr/Co permanent magnet alloy, achieved by conducting a part or whole of the aging treatment in the magnetic field, is based upon the fact that the two-phase separation structure is developed in an anisotropic manner by the application of the magnetic field. Therefore, the effect of application of magnetic field is significant particularly when it is conducted at the initial period of the aging, i.e. during the primary aging treatment, and a remarkable effect is brought about, accordingly. However, the application of magnetic field in an intermediate period of aging, i.e. during the aging at a low temperature range, has only a little significance. The application of magnetic field, therefore, is omitted in the secondary aging treatment in usual cases.

It is, however, to be noted that it is an essential requisite for obtaining an excellent permanent magnet to prevent as much as possible the formation of new two-phase separation structure, once the application of the magnetic field is stopped.

To this end, the present inventors have proposed an improved method in Japanese Patent Laid-Open Publication No. 99027/1978. According to this method, the aging treatment is conducted in two separate steps.

The first step is to maintain the alloy at a constant temperature in the magnetic field to form a metallurgical structure ordered in the direction of magnetic field, and the second step is to effect a continuous and gradual cooling over a predetermined temperature range below the above-mentioned constant temperature without application of the magnetic field to adjust the metallurgical structure which has been formed in the aging treatment under application of the magnetic field. In addition, after the completion of the aging treatment in the magnetic field, the cooling is made rapidly down to the temperature of commencement of the secondary aging treatment, so that the formation of two-phase separation structure without the action of the magnetic field is avoided.

In this method, it is essential in view of its principle, that a certain temperature gap be formed between the temperature at which the alloy is aged in the magnetic field and the temperature at which the secondary gradual cooling is commenced. This process, however, has been worked out mainly from a view point of formation of ideal two-phase separation structure. However, for achieving a large compositional difference between the two separated phases, which is one of the essential requisites for the alloy to exhibit a superior permanent magnet property, the presence of such a temperature gap is not preferred as will be easily understood from the foregoing description.

In order to avoid the above-stated inconvenience, the present invention in its one aspect provides, a novel method of producing an anisotropic Fe/Cr/Co alloy, in which the alloy is maintained under a magnetic field at a temperature below the two-phase separation temperature of the alloy and, thereafter, the alloy is maintained at a lower temperature under the magnetic field of the same direction.

This method will be described hereinunder with reference to, for example, a method wherein the alloy is maintained at an elevated temperature below the two-phase separation temperature of the alloy in a magnetic field to form an anisotropic structure and, thereafter, the alloy is cooled at a rate which is not so high, while maintaining the application of the magnetic field, thereby to make each of two separated phases approach the equilibrium composition at low temperature.

According to this method, even if there is a new two-phase separation process during the slow cooling, the metallurgical structure is ordered because this new two-phase separation takes place under the influence of the magnetic field. As a result, the disorder or disturbance of the anisotropy is avoided as much as possible and the ideal state of the structure as a whole is achieved while maintaining the structures of two phases in the desirable states.

The effect of this heat treatment becomes appreciable when the cooling in the magnetic field is conducted from the elevated treating temperature in the magnetic field down to a temperature at least 5° C. lower than the elevated temperature. Preferably, the cooling is effected over a temperature range from the elevated treating temperature to a temperature at least 10° C. below the elevated temperature, more preferably down to a temperature at least 20° C. below the elevated treating temperature.

Considering the significance of cooling treatment in the magnetic field, it will be readily understood that the effect of this heat treatment is obtainable also by the following process.

For instance, the heat treatment of the first aspect of the invention can be achieved also in the following manner. At first the alloy is maintained at an elevated temperature below the two-phase separation temperature of the alloy in a magnetic field to form an anisotropic two-phase separation structure. Then, under the influence of the same magnetic field, the alloy is heated to and maintained at a temperature below the first-mentioned temperature. This heating and maintaining at the lowered temperature is made once or repeated for a plurality of times. Thus, this method can be referred to as "multi-stage aging treatment in the magnetic field".

Also, the method of the first aspect of the invention can be carried out in the following manner. At first the alloy is treated at an elevated temperature below the two-phase separation temperature in the magnetic field. Then, the alloy is cooled in an ordinary manner, i.e. in the atmosphere and, then, heated to and maintained at a temperature lower than the elevated temperature under the application of a magnetic field of the same direction. The cooling and reheating are conducted once or repeated for a plurality of times. Thus, this method can be referred to as "a repeated thermo-magnetic treatment method".

In each of these methods, it is recommendable to effect a secondary aging treatment for efficiently obtaining a superior magnetic property, by, for example, effecting a continuous cooling over a certain temperature range lower than the thermo-magnetic treatment temperature without application of the magnetic field.

As has been stated, the permanent magnetic property of the Fe/Cr/Co alloy becomes obtainable only through an aging treatment. As will be understood also from the foregoing description, in the conventional aging treatment, an adequate control of the aging condition is extremely important particularly in the initial period of aging, i.e. during the aging at high temperature range. This is because the geometrical factors of the two-phase separated microstructure such as size, configuration, volumetric ratio of the two phases, degree of orientation and so forth, which have decisive influence on the permanent magnetic property, are determined almost completely during the initial period of the aging effected at high temperature range. In this initial period, however, the two-phase separation mechanism itself inherently has a complicated temperature dependency and the rate of diffusion of the atoms for the two-phase separation is large. Therefore, the geometrical factors are largely fluctuated even by a slight deviation of the heat treatment condition, resulting in a large fluctuation of the magnetic property of the product.

For instance, for producing an anisotropic Fe/Cr/Co alloy has been manufactured conventionally by maintaining the alloy at an elevated temperature below the two-phase separation temperature under influence of a magnetic field and then subjecting the alloy to a secondary aging treatment of a continuous cooling of a multi-stage aging treatment without the application of the magnetic field. In this conventional method, however, the magnetic property of the product is largely changed depending on the treating condition during the first step of aging in the magnetic field.

This causes an unstable property of the product magnet, permit the production of unacceptable goods or unacceptably large fluctuation of the property of the product. If a strict control for the treating condition is effected, the quantity of the product which can be treated at a batch is decreased. Thus, the conventional method is quite unsuitable for the production in an industrial scale. For this reason, the Fe/Cr/Co permanent magnet alloy has not been put into practical use.

Generally speaking, such a treatment as to heat a predetermined quantity of articles to a predetermined temperature and to maintain them for a predetermined time at that temperature seems to be easy to carry out, because the concept of such an idea is comparatively simple. As a matter of fact, however, it is rather difficult to carry out such a treatment in an industrial scale. In sharp contrast to the above, a cooling type treatment is much easier to perform, provided that the temperatures at which the cooling is started and at which the cooling is ended need not be controlled so precisely and that it is required only to precisely control the cooling rate over a predetermined temperature range, except the case where an extremely small cooling rate is required. For instance, such a cooling can be achieved easily and stably by wrapping the articles with suitable heat-insulating material, or by adopting a programmed control of electric oven.

Under these circumstances, it is remarkable that the invention provides an improved method as stated hereinunder. Namely, the aging treatment of Fe/Cr/Co alloy in a magnetic field is carried out by continuously cooling the alloy over a predetermined temperature range in the magnetic field. This cooling is commenced at a temperature higher than the two-phase separation temperature of the alloy and is continued down to a temperature which is not higher than the two-phase separation temperature of the alloy. Thus, the two-phase separation is commenced during this continuous cooling under the influence of the magnetic field to form the metallurgical structure. By so doing, the commencement of the two-phase separation at the initial stage of the aging is avoided perfectly, so that it becomes unnecessary to make a precise temperature control and, accordingly, the requirement for control of the heat treatment condition becomes less severe.

This heat treatment method offers, from an entirely different standpoint, an advantageous stabilization of the magnetic property.

Supposing here that a two-phase separated microstructure is formed by maintaining the alloy at a temperature below the two-phase separation temperature of the alloy as in the conventional case, the two-phase separation mechanism itself has a complicated temperature dependency at such a temperature range as heretofore described and, in addition, the rate of diffusion of atoms for the two-phase separation is large. Therefore, as has been repeatedly explained, it is essential to pay greatest care to the heat treating condition, in order to obtain a metallurgical structure which would ensure a superior permanent magnetic property.

Since the situation is so delicate, the optimum heat treating condition which would ensure the highest magnetic property of the product, particularly the optimum treating temperature, is largely affected by the alloy composition. For this reason, it is often experienced that the desired magnetic property cannot be obtained, even by a heat treatment under the predetermined condition, due to a slight deviation of the alloy composition from the desired one. This is attributable mainly to a change in the metallographical parameters such as binodal temperature and spinodal temperature due to the deviation of the alloy composition.

In order to overcome this problem, conventionally, it has been a necessary measure to strictly control the alloy composition in order to make the latter in an allowable range, test treatment prior to treatment of each lod and so forth.

However, if the cooling is commenced at a temperature higher than the two-phase separation temperature of the alloy as in the case of the invention, the two-phase separation is started only after the temperature has come down below the two-phase separation temperature. Therefore, even if a slight change of the metallographical parameters of the alloy such as two-phase separation temperature has taken place due to the deviation of the alloy composition, the structure is changed substantially in a constant manner although there may be a slight change of times at which the two-phase separation process is commenced and ended. Thus, no substantial difference is caused once the alloy temperature is lowered below the temperature range around the two-phase separation temperature.

Therefore, according to the heat treating method of the invention described above, it is expected that the fluctuation of the magnetic property of the product attributable to the deviation of the alloy composition be greatly suppressed as compared with the conventional treating process.

In case of the cooling started at a temperature above the two-phase separation temperature of the alloy, however, the two-phase separation is generated in the course of the cooling from the state of $\alpha$ single phase. Therefore, as will be seen from FIG. 1*a*, the metallurgical structure which is formed at a moment at which the temperature has come down to Td to permit the separation of $\alpha$ phase into $\alpha_1$ and $\alpha_2$ phases is a two-phase separated microstructure generated by the nucleation-and-growth mechanism. For the reasons which have been described already, this structure is not favourable from the view point of magnetic property. Therefore, it has been considered, as a common sense, that the good magnetic property cannot be obtained by the continuous cooling from the $\alpha$ single phase. Accordingly, the continuous cooling from the state of single $\alpha$ phase has not been practically adopted in the heat treatment of the alloy of the kind described.

However, according to the consideration made by the present inventors, the difference between the spinodal decomposition mechanism and the nucleation-and-growth mechanism is not so distinctive, although the study has not progressed yet to such an extent as to provide a quantitative explanation. Namely, it proved that the nucleation-and-growth mechanism can involve a factor similar to the spinodal decomposition mechanism, and that the spinodal decomposition mechanism can contain factor similar to the nucleation-and-growth mechanism.

More specifically, from a microscopic point of view, the energy felt by atoms taking part in the two-phase separation is not necessarily coincides with the thermodynamical energy to which an approach has been made from a macroscopic point of view. Therefore, the present inventors considers that the actual process of the two-phase separation cannot be fully explained solely with either one of the theory of nucleation-and-growth mechanism and the theory of spinodal decomposition.

The spinodal line shown by broken line in the phase diagram shown in FIG. 1*a* has no such an absolute meaning to definitely divide the two-phase separation mechanism as in the conventional sense. In other words, this line gives from a dynamic point of view only a standard of border between two modes of two-phase separation mechanism. Namely, it is considered that the reaction represented by the spinodal decomposition mechanism is dominative at one side of this line, while, at the other side, the reaction represented by nucleation-and-growth mechanism is dominative.

Should the case be so, there is no such distinctive nor inherent difference between two modes of two-phase separation mechanisms as in the conventional sense. It is, therefore, possible to obtain an adequate two-phase separated microstructure even by the cooling type treatment, provided that the temperature range of cooling and the cooling rate are selected appropriately.

It is therefore expected that, in some cases, the cooling type treatment can provide a magnetic property equivalent to that obtained through the conventional treatment in which the alloy is maintained at a constant temperature in the spinodal temperature range.

The method in accordance with the second aspect of the invention has been made as a fruit of a full consideration of the above described points. Namely, according to the second aspect of the invention, there is provided a method of producing an anisotropic magnet alloy containing iron, chromium and cobalt, in which the aging treatment of the alloy under the influence of the magnetic field is conducted by effecting a continuous cooling of the alloy over a predetermined temperature range in the magnetic field. In addition, this cooling is started at an elevated temperature higher than the two-phase separation temperature of the alloy and is continued down to a temperature which is not higher than the two-phase separation temperature, thereby to start the two-phase separation process in the alloy during this continuous cooling under the influence of the magnetic field to form the microstructure.

The inventors have experimentarily applied this method to various alloys under various testing conditions, and confirmed that the expected superior effects are obtainable, as will be realized from the description of examples which will be given later.

For informations, the advantages of the invention achieved by the first invention are also brought about in this second invention, if the cooling in the magnetic field is continued to a certain low temperature. In most cases, good result was obtained over a wide variety of alloy composition, by effecting the continuous cooling down to a temperature of about 620° C. or lower. On the other hand, the lower limit of the temperature at which the cooling in the magnetic field is commenced for carrying out the invention is determined depending on the alloy structure. In most cases, favourable results were obtained when the cooling was commenced at a temperature of about 650° C. or higher.

With respect to the magnetic property, the present inventors have expected in view of the foregoing consideration that the magnetic property obtained by the method of the invention would not exceed at the best the magnetic property obtained through the conventional method in which the treatment is started with the heating and maintaining of the alloy at a constant temperature in the spinodal temperature range.

However, experiment showed that, as will be understood from the description of the Example given later, the method of the invention in some cases provides a higher magnetic property than the conventional method. This fact cannot be fully explained solely from the consideration of the mechanism of the aging treatment described hereinbefore. Thus, a full consideration including a kinematic dynamical approach will be necessary to clarify the mechanism of the process of two-phase separation, particularly of the initial stage of the two-phase separation process.

Thus, the reason why the heat treating method of the invention is so effective and superior has not been fully clarified theoretically, and there remains some aspects which are still unclarified.

It is true, however, that the method of the invention, which is quite easy to practice and which is highly efficient, can provide a permanent magnetic property which is superior to that obtained through the conventional method. The inventors, therefore, proposes this invention convincing that the abovestated fact undoubtedly has a large significance from the industrial point of view.

The inventors are very much interested in the theoretical approach to the points heretofore described and believes that such an approach will further contributes to the enhancement of utility of this kind of magnet alloy.

The advantages of two aspects of the invention will be fully realized from the following description of Examples of the invention.

EXAMPLE 1

An ingot having a weight of 5 Kg was obtained by melting an alloy containing, by weight, 24% of chromium, 12% of cobalt, 1.3% of tin and the remainder iron, by means of a high-frequency melting. The ingot was then subjected to a hot rolling and a subsequent cold rolling into the form of a plate of 2 mm thick. A rectangular test piece of 10 mm wide and 20 mm long was cut out from this plate and subjected to a 10-minute solution treatment at 1000° C. so as to be used as a specimen.

This specimen was placed in a magnetic field of 2000 Oe and was heated to and maintained for 5 minutes at 645° C. which is lower than the two-phase separation temperature of this alloy. Thereafter, the specimen was subjected to an aging which includes cooling under the presence of the magnetic field at a rate of 0.5° C. per minute down to 610° C. and a subsequent cooling in the air. Then, as the secondary aging treatment, a heating was made to heat up the specimen up to 580° C. without application of the magnetic field. The specimen was maintained at that temperature for 70 minutes, and was subjected to a continuous cooling which was effected down to 470° C. at such a cooling rate as to require 16 hours for 100° C. temperature drop. As to the magnetic property, this alloy showed Hc of 564 Oe, Br of 14.1 KG and (BH)max of 6.4 MGOe.

For a comparison purpose, the same specimen was subjected to a conventional treatment in the magnetic field which was conducted by maintaining the specimen at a constant temperature of 645° C. for 60 minutes in the magnetic field of 2000 Oe. This reference specimen was then subjected to the same secondary aging as stated above. This reference specimen showed Hc of 322 Oe, Br of 14.3 KG and (BH)max of 3.5 MGOe.

EXAMPLE 2

An alloy containing, by weight, 26% of chromium, 13% of cobalt, 1.3% of tin, 0.5% of titanium and the remainder iron was molten by means of a high-frequency melting method, and was cast by a shell mold to become a test piece of 14$\phi\times$13 l. This test piece was used as the specimen after a 10-minute solution treatment at 1150° C.

The specimen was placed in a magnetic field of 2000 Oe and was heated to and maintained at 645° C. which is lower than the two-phase separation temperature of the alloy for 10 minutes. Thereafter, while the application of the magnetic field is being continued, the specimen was cooled down to 605° C. at a rate of 1° C. per minute and then cooled in the air out of the oven. Then, the specimen was subjected to a secondary aging treatment in which it was first heated up to 590° C. without application of magnetic field and maintained at that temperature for 60 minutes, and finally continuously cooled down to 475° C. at such a cooling rate as requiring 16 hours for 100° C. temperature drop.

As to the magnetic property, this treated specimen showed Hc of 593 Oe, Br of 13.3 KG and (BH)max of 6.0 MGOe. By way of reference, the same specimen was subjected to a conventional aging treatment in the magnetic field in which it was maintained at 645° C. for 60 minutes under the presence of magnetic field of about 2000 Oe, insteadly of the above described aging treatment in the magnetic field. The reference specimen was then subjected to the same secondary aging treatment as above. The reference specimen thus treated showed Hc of 520 Oe, Br of 13.3 KG and (BH)max of 4.9 MGOe.

EXAMPLE 3

An alloy containing, by weight, 27% of chromium, 12.5% of cobalt, 1.3% of tin and the remainder iron was prepared in the same way as the first example. The alloy was then subjected to a 10-minute solution treatment at 1100° C. to become a specimen. The specimen was then placed in the magnetic field of about 2000 Oe and was heated to 635° C. which is lower than the two-phase separation temperature of this alloy. The specimen was maintained at that temperature for 30 minutes and was transferred to another oven B which has been beforehand heated up to 620° C. The specimen was held in that oven B for 60 minutes under the influence of magnetic field of 4000 Oe. In this case, since the specimen has a small mass, the temperature of the specimen was lowered to 620° C. in 3 minutes after the transfer to the oven B. Then, a secondary aging treatment was effected in the same manner as Example 2. This specimen showed Hc of 586 Oe, Br of 13.1 KG and (BH)max of 5.7 KG.

By way of reference, the same specimen was subjected, insteadly of the above described aging treatment in the magnetic field, to a conventional aging treatment in the magnetic field in which the specimen was maintained at 635° C. for 70 minutes in the magnetic field of about 4000 Oe. The specimen was then treated in the same manner as the secondary aging treatment stated above. This reference specimen showed Hc of 497 Oe, Br of 13.1 KG and (HB)max of 4.8 MGOe.

EXAMPLE 4

An alloy containing, by weight, 24% of chromium, 12% of cobalt, 1.3% of tin and the remainder iron was prepared in the same manner as Example 1. The alloy was subjected to a 10-minute solution treatment to become a specimen. The specimen (a) was placed in a magnetic field of about 2000 Oe and was heated up to 650° C. which is lower than the two-phase separation temperature of this alloy. After having been maintained at that temperature for 60 minutes, the specimen (a) was taken out of the oven and cooled in the air. Another specimen (b) was subjected to the same treatment except that the heating temperature was 645° C. Both of the specimen (a) and specimen (b) were subjected to an aging treatment in the magnetic field in which they were maintained at a temperature of 630° C. for 60 minutes under the influence of magnetic field of about 2000 Oe. The specimen (a) and (b) were then subjected to a secondary aging treatment which includes the steps of heating to and maintaining at 585° C. for 60 minutes without application of the magnetic field and cooling continuously down to 470° C. at such a cooling rate as requiring 16 hours for 100° C. temperature drop. The specimen (a) showed Hc of 560 Oe, Br of 13.9 KG and (BH)max of 6.1 MGOe, while the specimen (b) showed Hc of 550 Oe, Br of 13.9 KG and (BH)max of 5.9 MGOe.

By way of reference, the same specimen was subjected, insteadly of above described aging treatment in the magnetic field, to a conventional aging treatment in the magnetic field in which the specimen was maintained 60 minutes at 645° C. in a magnetic field of about 2000 Oe. The reference specimen was then subjected to a secondary aging treatment which was conducted in the same manner as the above described secondary aging treatment. The reference specimen thus treated showed Hc of 500 Oe, Br of 13.8 KG and (BH)max of 5.4 MGOe.

EXAMPLE 5

An alloy containing, by weight, 24% of chromium, 14% of cobalt, 1.3% of tin and the remainder iron was prepared in the same way as Example 1. The alloy was subjected to a 10-minute solution treatment to become a specimen. This specimen was heated, without the application of magnetic field, to 680° C. which is higher than the two-phase separation temperature of this alloy and was maintained at that temperature for 45 minutes. Then, the specimen was cooled, under the influence of a magnetic field of about 2000 Oe, down to a temperature of 600° C. which is lower than the two-phase separation temperature, at a cooling rate of 1.33° C. per minute. Thereafter, the specimen was taken out of the oven and cooled in the air.

Then, the specimen was subjected to a secondary aging treatment which has the steps of heating to and maintaining at 590° C. for 60 minutes without application of the magnetic field and continuously cooling down to 470° C. at such a cooling rate as requiring 16 hours for 100° C. temperature drop. This specimen finally showed Hc of 593 Oe, Br of 14.0 KG and (BH)max of 6.7 MGOe.

For a comparison purpose, a reference specimen was subjected, insteadly of the above-described aging treatment in the magnetic field, to a conventional aging treatment in the magnetic field in which the specimen was heated to and maintained at 645° C. which is lower than the two-phase separation temperature, for 60 minutes under the application of the magnetic field of about 2000 Oe. The reference specimen thereafter was subjected to a secondary aging treatment which was conducted in the same manner as the above-described secondary aging treatment. The reference specimen thus treated showed Hc of 620 Oe, Br of 13.0 KG and Hc of 6.5 MGOe.

EXAMPLE 6

Figure 2:
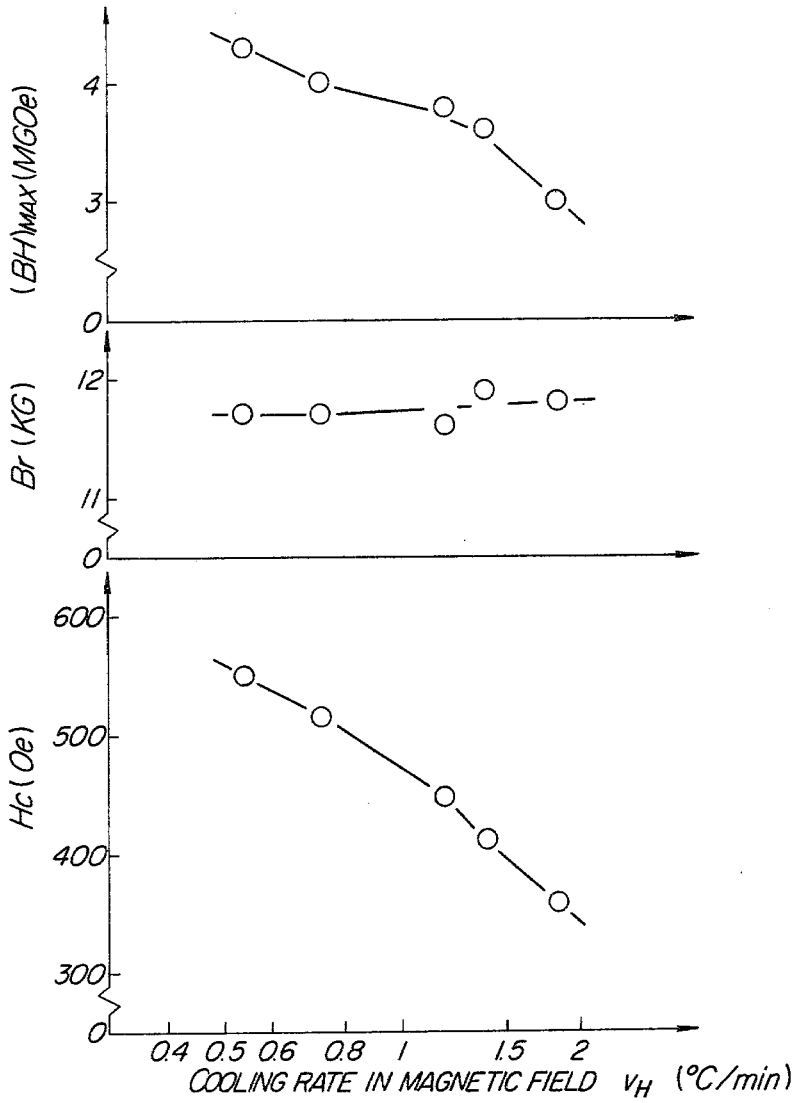
FIGS. 2 to 6 are graphs showing the dependency of Br, Hc and (BH)max on vH.

An alloy containing, by weight, 30% of chromium, 10% of cobalt, 0.5% of tin and the remainder iron was prepared in the same manner as Example 1. The alloy was solution-treated for 20 minutes at 900° C. A plurality of specimen was cut out from this alloy. These specimens were heated, without application of the magnetic field, up to 680° C. which is higher than the two-phase separation temperature of this alloy and were maintained at that temperature for 30 minutes. Then, while applying magnetic field of about 2000 Oe, the specimen were cooled down to 600° C. which is lower than the two-phase separation temperature at various cooling rates vH. The specimens were then taken out of the oven and cooled in the air. The specimen were then subjected to a secondary aging treatment which includes heating to and maintaining at 600° C., without application of the magnetic field, for 45 minutes and effecting a continuous cooling down to 485° C. at such a cooling rate as requiring 16 hours for 100° C. temperature drop. The magnetic properties of the specimens thus treated were as shown in FIG. 2 from which it will be seen the magnetic property has a dependency on the cooling rate of cooling in the magnetic field.

EXAMPLE 7

Figure 3:
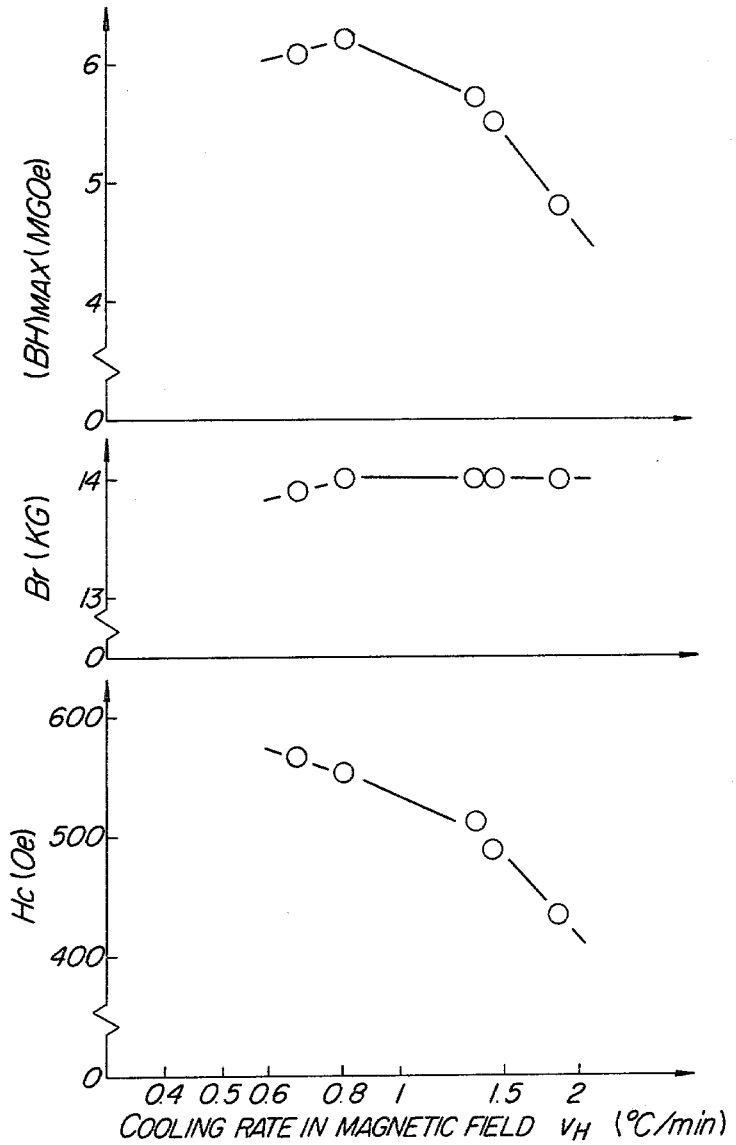

An alloy containing, by weight, 24% of chromium, 12% of cobalt, 1.3% of tin and the remainder iron was prepared in the same way as Example 6. Specimens were obtained after a 10-minute solution treatment at 1100° C. These specimens were subjected to an aging in the magnetic field and to a secondary aging treatment which were conducted in the same manner as Example 6. The magnetic properties of these specimens showed dependency on the cooling rate vH in the magnetic field as will be seen from FIG. 3.

EXAMPLE 8

Figure 4:
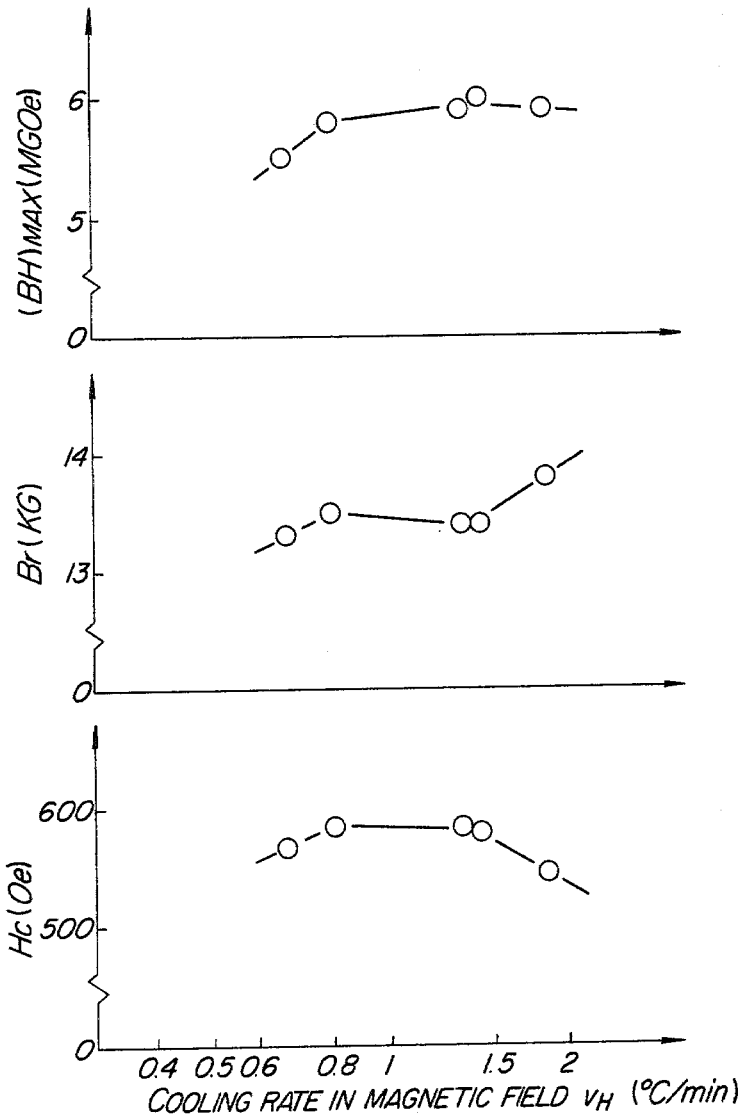

As alloy containing, by weight, 25% of chromium, 13% of cobalt, 1.3% of tin and the remainder iron was prepared in the same manner as Example 7. A solution treatment, aging treatment in a magnetic field and a secondary aging treatment were carried out in the same manner as those of Example 7. The magnetic properties of the specimens thus treated showed dependency on the cooling rate vH of the cooling in the magnetic field as shown in FIG. 4.

EXAMPLE 9

Figure 5:
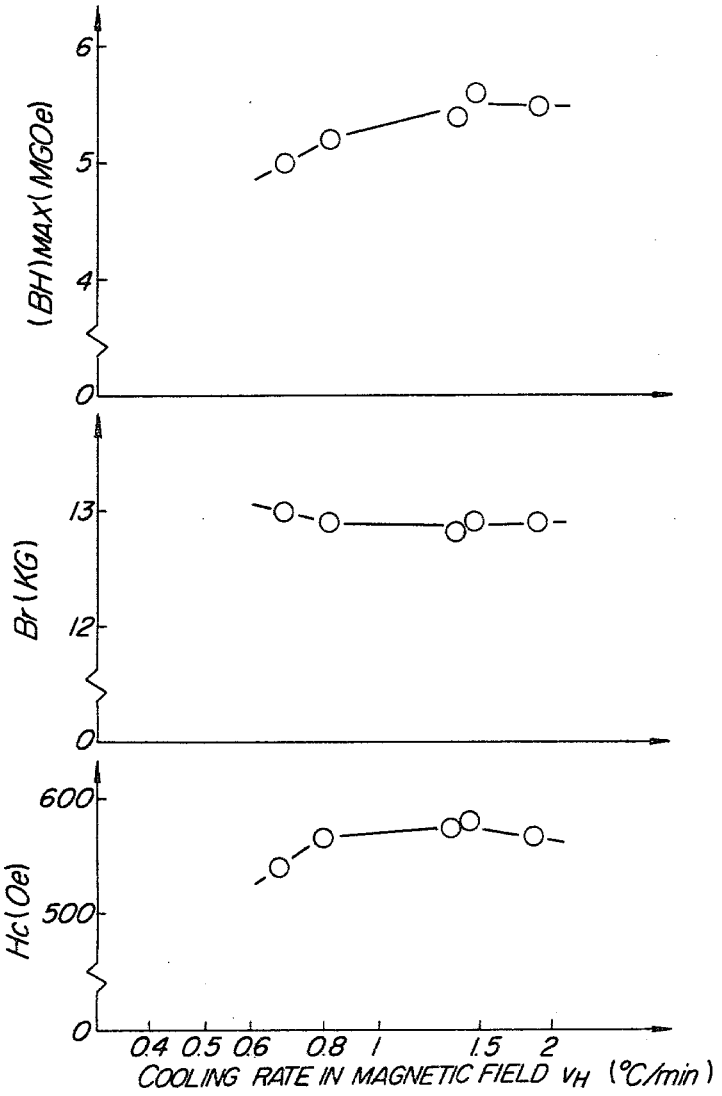

An alloy containing, by weight, 26% of chromium, 13% of cobalt, 1.3% of tin and the remainder iron was prepared in the same way as Example 7. A solution treatment, aging treatment in the magnetic field and a secondary aging treatment were conducted in the same manner as those in Example 7. The magnetic properties of the specimens thus treated showed a dependency on the cooling rate vH of the cocling in the magnetic field, as will be seen from FIG. 5.

EXAMPLE 10

Figure 6:
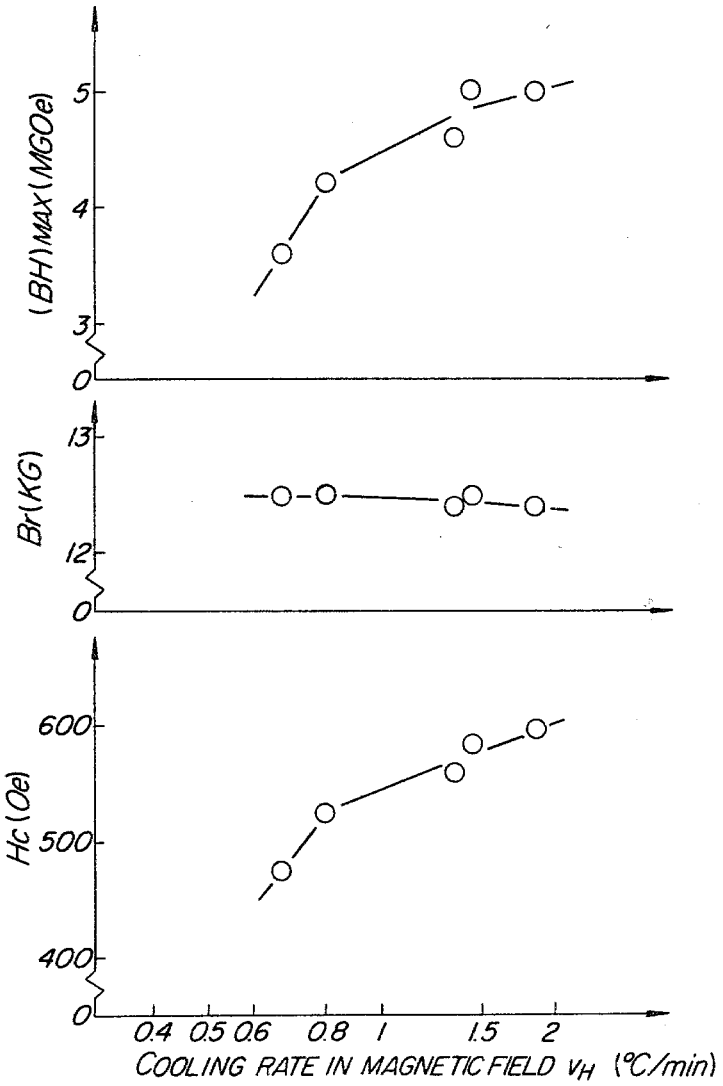

An alloy containing, by weight, 27% of chromium, 14% of cobalt, 1.3% of tin and the remainder iron was prepared in the same manner as Example 7. A solution treatment, aging treatment in the magnetic field and a secondary aging treatment were conducted in the same manner as those of Example 7. The specimens thus treated showed magnetic properties which have dependency on the cooling rate vH during the cooling in the magnetic field, as shown in FIG. 6.

EXAMPLE 11

Figure 7:
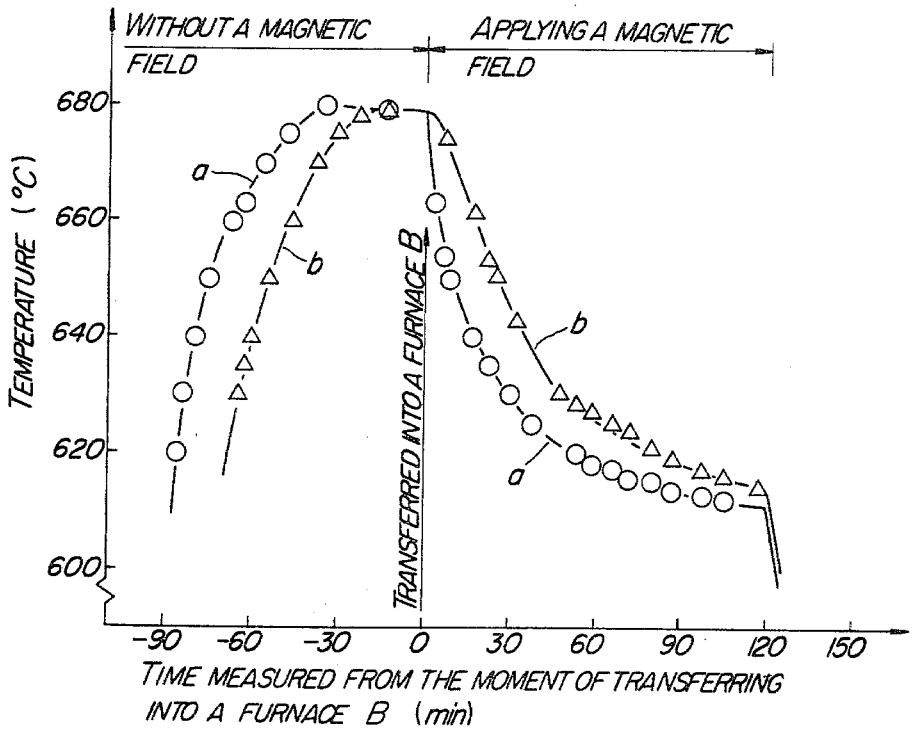
FIG. 7 is a chart showing the relation between the time lapsed after placing of the article in a furnace and the change of temperature of the article.

An ingot having a weight of 500 Kg was produced by means of a high-frequency melting from an alloy containing, by weight, 30% of chromium, 10% of cobalt, 0.5% of tin and the remainder iron. The ingot was subjected to a hot rolling and then to a cold rolling to become a plate of 2.5 mm thick. The plate was then suitably cut to form a specimen of a total weight of 10 Kg. The specimen was then subjected to a 5-minute solution treatment at 900° C. Thermocouples for detecting the temperatures were attached to a point (a) on the surface of the specimen and to a central point (b) of the same. Then, the specimen was heated, without application of the magnetic field, to 680° C. which is higher than the two-phase separation temperature of this alloy. At a moment by which the points (a) and (b) have been maintained at that temperature for about 40 minutes and about 20 minutes, respectively, the specimen was transferred to another oven B which has been beforehand heated to 610° C. which is lower than two-phase separation temperature of this alloy. By this transfer of the specimen, the continuous cooling was effected from 680° C. to 610° C., and the magnetic field of about 2000 Oe was applied. At a moment two hours after the transfer to the oven B at which the temperature of the center (b) has been lowered down to 615° C., the specimen was taken out of the oven and cooled in the air. The state of heating and cooling of the specimen as measured at the points (a) and (b) is shown in FIG. 7.

Subsequently, the specimen was subjected to a secondary aging treatment which includes heating up to 600° C. without applying the magnetic field and cooling down to 490° C. continuously at such a cooling rate as requiring 16 hours for 100° C. temperature drop.

The portion of the specimen around the point (a) showed a magnetic property having Hc of 575 Oe, Br of 11.8 KG and (BH)max of 4.2 MGOe, while the portion of the same around the point (b) showed Hc of 533 Oe, Br of 11.8 KG and (BH)max of 4.0 MGOe.

From the foregoing description, it will be understood that the present invention provides a method of producing an anisotropic permanent magnet alloy mainly constituted by iron, chromium and cobalt, which method permits a stable, efficient and full use of the advantages of this alloy in an industrial scale.

What is claimed is:

1. A method of producing an anisotropic magnet alloy containing 17 to 45 weight % of chromium, 5 to 35 weight % of cobalt and the balance being essentially of iron in which a part of an aging treatment for making the alloy have a permanent magnetic property is conducted in a magnetic field to render the alloy anisotropical, which comprises effecting an aging treatment by at first maintaining said alloy in the magnetic field at a first temperature below the transformation temperature of said alloy at which two phases occur from a single phase, cooling the alloy at a rate of 0.05° to 10° C. per minute and then maintaining said alloy under a magnetic field in the same direction at a second temperature lower than said first temperature and below said transformation temperature.

2. A method of producing an anisotropic magnet alloy containing iron, chromium and cobalt as claimed in claim 1, wherein said cooling is effected at a rate of 0.2° to 5° C. per minute.

3. A method of producing an anisotropic magnet alloy containing iron, chromium and cobalt as claimed in claim 2, wherein said cooling is effected at a rate of 0.5° to 2° C. per minute.

4. A method of producing an anisotropic magnet alloy containing iron, chromium and cobalt as claimed in claim 3, wherein the cooling is effected over a temperature range that extends down to a temperature at least 5° C. below said first temperature.

5. A method of producing an anisotropic magnet alloy containing iron, chromium and cobalt as claimed in claim 4, wherein said cooling is effected over a temperature range that extends down to a temperature which is more than 10° C. lower than said first temperature.

6. A method of producing an anisotropic magnet alloy containing iron, chromium and cobalt as claimed in claim 5, wherein said cooling treatment is effected over a temperature range that extends to a temperature which is more than 20° C. lower than said first temperature.

7. A method of producing an anisotropic magnet alloy containing iron, chromium and cobalt as claimed in claim 1, which further comprises maintaining the alloy maintained at the second temperature at still another temperature below said second temperature while applying a magnetic field in the same direction and thereafter repeating the additional magnetic application by further reducing the temperature incrementally.

8. A method of producing an anisotropic magnet alloy containing 17 to 45 weight % chromium, 5 to 35 weight % of cobalt and the balance being essentially of iron, in which a part of an aging treatment for making the alloy have a permanent magnetic property is conducted in a magnetic field to render the alloy anisotropical, which comprises effecting an aging treatment by at first maintaining said alloy in the magnetic field at a first temperature below the transformation temperature of said alloy at which two phases occur from a single phase, cooling the alloy at a rate of 0.05° to 10° C. per minute in the atmosphere, and then heating said alloy, while applying a magnetic field in the same direction, to a second temperature lower than the first temperature and below said transformation temperature, and maintaining said alloy under the magnetic field in the same direction at the second temperature, said aging treatment being conducted once or repeated two or more times.

9. A method of producing an anisotropic magnet alloy containing iron, chromium and cobalt as claimed in claim 1, wherein said alloy contains 23 to 35 weight percent of chromium and 5 to 20 weight percent of cobalt.

10. A method of producing an anisotropic magnet alloy containing iron, chromium and cobalt as claimed in claim 9, wherein said alloy contains 23 to 35 weight percent of chromium and 5 to less than 15 weight percent of cobalt.

11. A method of producing an anisotropic magnet alloy containing iron, chromium and cobalt as claimed in claim 1, wherein said alloy is directly cooled from said first temperature to the second temperature within the same furnace.

12. A method of producing an anisotropic magnet alloy containing 17 to 45 weight % of chromium, 5 to 35 weight % of cobalt and the balance being essentially of iron in which a part of an aging treatment making the alloy have a permanent magnetic property is conducted in a magnetic field to render the alloy anisotropical, which comprises effecting an aging treatment by at first maintaining said alloy in the magnetic field at a first temperature below the transformation temperature of said alloy at which two phases occur from a single phase, cooling the alloy at a rate of 0.05° to 10° C. per minute and then maintaining said alloy under a magnetic field in the same direction at a second temperature lower than the first temperature and below said transformation temperature, said alloy being transferred from a first furnace in which the temperature is maintained at said first temperature to a second furnace in which the temperature is maintained at the second temperature.

13. A method of producing an anisotropic magnet alloy containing 17 to 45 weight % of chromium, 5 to 35 weight % of cobalt and the balance being essentially of iron in which a part of an aging treatment for making the alloy have a permanent magnet property is conducted in a magnetic field to render the alloy anisotropic, which comprises effecting an aging treatment by continuously cooling said alloy over a predetermined temperature range in said magnetic field, the cooling of said alloy in said magnetic field being commenced at a temperature higher than the transformation temperature of said alloy at which two phases occur from a single phase, and continued down to a temperature below said transformation temperature thereby to start the phase transformational reaction in said alloy during the continuous cooling to form the alloy having the permanent magnet property, said cooling being effected at a rate of 0.05° to 10° C. per minute.

14. A method of producing an anisotropic magnet alloy containing iron, chromium and cobalt as claimed in claim 13, wherein the cooling aging treatment in said magnetic field is commenced at a temperature of 650° C. or higher.

15. A method of producing an anisotropic magnet alloy containing iron, chromium and cobalt as claimed in claim 14, wherein said cooling aging treatment in said magnetic field is continued down to a temperature of 650° C. or lower.

16. A method of producing an anisotropic magnet alloy containing iron, chromium and cobalt as claimed in any one of claim 13 to 15, wherein said cooling in said magnetic field is effected at a rate of 0.2° to 5° C. per minute.

17. A method of producing an anisotropic magnet alloy containing iron, chromium and cobalt as claimed in claim 16, wherein said cooling in said magnetic field is effected at a rate of 0.5° to 2° C. per minute.

18. A method of producing an anisotropic magnet alloy containing 17 to 45 weight % of chromium, 5 to 35 weight % of cobalt and the balance being essentially of iron in which a part of an aging treatment for making the alloy have permanent magnet property is conducted in a magnetic field to render the alloy anisotropic, which comprises effecting an aging treatment by continuously cooling said alloy over a predetermined temperature range in said magnetic field, the cooling of said alloy in said magnetic field being commenced at a temperature higher than the transformation temperature of said alloy at which two phases occur from a single phase, and continued down to a temperature below said transformation temperature thereby to start the phase transformational reaction in said alloy during the continuous cooling to form the alloy having the permanent magnetic property, said cooling being effected at a rate of 0.05° to 10° C. per minute and said cooling in said magnetic field being conducted by heating said alloy up to a temperature higher than the transformation temperature of said alloy in a first furnace and then transferring said alloy to another furnace from which it is maintained at a temperature below said transformation temperature to effect the cooling of said alloy from said temperature higher than said transformation temperature down to said temperature below said transformation temperature and applying said magnetic field during said cooling.

* * * * *